US007790972B2

(12) United States Patent
Stewart

(10) Patent No.: US 7,790,972 B2
(45) Date of Patent: Sep. 7, 2010

(54) KEYBOARD HAVING KEY SPACING

(76) Inventor: Allan Michael Stewart, 86 Nightingale Road, London (GB) N22 8PP ( * ) Notice: Subject to any disclaimer, the term of this patent is extended or adjusted under 35 U.S.C. 154(b) by 548 days.

(21) Appl. No.: 10/593,985

(22) PCT Filed: Mar. 23, 2005

(86) PCT No.: PCT/GB2005/001165

§ 371 (c)(1),
(2), (4) Date: Oct. 24, 2006

(87) PCT Pub. No.: WO2005/093710

PCT Pub. Date: Oct. 6, 2005

(65) Prior Publication Data

US 2007/0214937 A1 Sep. 20, 2007

(30) Foreign Application Priority Data

Mar. 23, 2004 (GB) ..... 0406470.5

(51) Int. Cl.
*G10C 3/12* (2006.01)
*G10H 1/06* (2006.01)

(52) U.S. Cl. ..... 84/423 R; 84/429; 84/423 B; 84/602; 84/622; 84/644

(58) Field of Classification Search ..... 84/423 R, 84/744
See application file for complete search history.

(56) References Cited

U.S. PATENT DOCUMENTS 4,022,097 A * 5/1977 Strangio ..... 84/635
4,042,777 A 8/1977 Bequaert et al.
4,065,650 A 12/1977 Lou et al.
4,549,279 A 10/1985 Lapeyre et al.
4,891,777 A 1/1990 Lapeyre
4,972,752 A * 11/1990 Van Duyne ..... 84/423 R
5,313,010 A * 5/1994 Matsushima et al. ..... 84/600
5,557,057 A 9/1996 Starr et al.
5,565,641 A 10/1996 Gruenbaum
5,648,630 A 7/1997 Vanderboort
5,841,052 A * 11/1998 Stanton ..... 84/600
5,990,411 A * 11/1999 Kellar ..... 84/742
2003/0209130 A1 11/2003 Anderson et al.

FOREIGN PATENT DOCUMENTS

| | | |
|---|---|---|
| EP | 0 039 464 | 11/1981 |
| EP | 0 351 862 | 1/1990 |
| FR | 2 376 480 | 7/1978 |
| SU | 1 234 877 | 5/1986 |

* cited by examiner

*Primary Examiner*—Jeffrey Donels
*Assistant Examiner*—Christopher Uhlir
(74) *Attorney, Agent, or Firm*—Collard & Roe, P.C.

(57) ABSTRACT

A keyboard unit (10) comprising a plurality of keys (12) surrounding a centre (14) and operable singly and chordally by a single finger (or thumb). Preferred arrangements consist of three, four or seven surrounding keys (12), particularly for playing musical notes of an octave. A keyboard (16) may comprise a plurality of spaced apart units (10) in groups (18) operable by respective fingers. The different units (10) may operate different instrumental sounds. Variations include shift functions, operation of lights, e.g. in mixed sequence with notes, operation of alphanumeric characters, e.g. to produce up to a 10-character word or grouping simultaneously. The keyboard (16) may be on the back of a guitar neck (30) or arranged to correspond to the keys on a piano. Logical circuitry and mosaic and adapted QWERTY keyboards are described, also a piano keyboard with phantom black notes.

19 Claims, 3 Drawing Sheets

KEYBOARD HAVING KEY SPACING

CROSS REFERENCE TO RELATED APPLICATIONS

Applicants claim priority under 35 U.S.C. §119 of Great Britain Application No. 0406470.5 filed Mar. 23, 2004. Applicants also claim priority under 35 U.S.C. §365 of PCT/GB2005/001165 filed Mar. 23, 2005. The international application under PCT article 21(2) was published in English.

FIELD OF THE INVENTION

This invention relates to keyboards.

BACKGROUND TO THE INVENTION

Keyboards are known to the present inventor in which the keys, when operated singly, carry out respective functions and, when two or more are operated together substantially simultaneously, carry out a further function, which is called "chordal operation". This is different from simply playing two keys together on e.g. a piano, which simply carries out the functions of both but does not carry out any new and different function.

Prior art keyboards with large numbers of keys are generally not economical in layout or, if they are, are not conducive to easy learning of the key functions and the chordal possibilities. Other disadvantages are discussed below.

SUMMARY

According to one aspect of this invention, there is provided a keyboard unit comprising a plurality of keys surrounding a centre and operable singly and chordally by a single finger (which term includes a thumb). Preferably, such a unit is operable by the finger with only slight displacement for the operation of the different keys and usefully has a touchable area of some 2 cm. across, or perhaps 1½ to 3 cm. across depending on the number of keys. The keys can provide optical feedback, by markings and/or colours and their relative positions. They may also provide tactile feedback by shaping, roughening or other means, several of which are known. With a small number of keys to a unit, preferably with three to eight surrounding keys, more particularly 3, 4, 7 or 8, the operator should find it easy to memorise the positions of the keys and operate them selectively, even blind. The surrounding keys may have an outer ridge, which ridges run round the outer periphery of the set of surrounding keys considered as a ring (although this might not be circular). This allows a finger-tip to sense the position of the complete unit. A central projection in each ridge might then facilitate sensing of the orientation of the unit and/or the positions of the individual keys. Or, a central projection on each key might do this. A unit might have further keys beyond and/or around said surrounding keys.

The main application of this invention is to providing musical keyboards. The said keyboard unit is conceived of as providing one octave. For example, for a child's toy, the keys can be connected to operate by a single touch selectively the seven major notes of an octave of the musical scale, while, for more advanced play, the keys can be connected to operate by a single touch selectively the twelve semitone notes of an octave of the musical scale. At least six of the said seven notes or eleven of the said twelve notes are preferably operable in order going around the centre. The other note may be included in such order or may be a centre key.

A simple embodiment consists of three keys surrounding a centre. If there is no centre key, the keys are still operable to provide the seven major notes of an octave. If there is a centre key, the keys are operable to provide the twelve semitone notes of an octave. In either case, it is particularly useful to have the three surrounding keys connected to operate the respective notes doh, me, soh of a major chord. To avoid doubt in terminology, it is to be noted that the British system of naming the tonic sol-fah scale is used, according to which doh can be any note of the piano (or indeed any pitch) and the other notes have relative intervals therefrom. Equal temperament is assumed throughout the remainder of this description and the accompanying claims; but the invention can be embodied so as to enable playing perfect temperament (for one or for various scales), when e.g. C sharp is slightly different from D flat.

For playing musical notes, another particularly useful form of said unit consists of four said keys surrounding a centre. The keys in order around the centre may be connected to operate respectively doh, me, soh and te or to operate doh, me, soh and lah, each arrangement having advantages, the latter particularly enabling the ready playing of both major and minor scales. In either case, chordal playing of adjacent keys produces the other major notes. Chordal operation of other sets of two adjacent keys, or of three adjacent keys, can be chosen to produce the other semitone notes in the octave so that at is particularly easy for a musician to learn the required combinations. Examples are given later with reference to the accompanying drawings. Each arrangement has distinct advantages. For example, if a centre key is provided, this can produce a note a semitone higher (or lower) than without the centre key.

Another useful arrangement for a musician consists of seven keys surrounding a centre, e.g. corresponding to the major (natural) notes (i.e. the "white" keys of a piano if in the scale of C major) of an octave, with perhaps adjacent chordal pairs connected to produce semitone notes and perhaps a centre key to provide a shift function. For any number of keys, a centre key can provide a shift function when operated before, or chordally with, any one or set of surrounding keys, e.g. to operate a note a whole number of octaves above (or below) the same without the centre key.

With the large number of readily memorisable possibilities of such a key unit, this can be used alone. However in view of its possible very small and convenient size, a keyboard can be made comprising a plurality of spaced apart such units. These may be arranged so that a group of such units are operable by one and the same finger, giving possibly a vast range of notes operable by one finger. In a further embodiment, there can be a plurality of such groups arranged to be operable by respective fingers, giving enormous possibilities to the player. Each such group may pertain to a different instrumental sound, or one unit in each group may be connected to select a first instrumental sound, another unit in each of the same groups connected to select a second instrumental sound, and this may be furthered for other instrumental sounds. To produce an arrangement that is particularly easy to operate, the said units of each finger group are arranged in a column and the columns are approximately parallel, which facilitates simultaneous playing operation of some or all of the groups by a single hand. Clearly, two such arrangements can be provided for a person's two hands and, again, more than two such arrangements can be provided, corresponding to an instrument having a plurality of manuals. The units can also be arranged in positions corresponding to the keys on a piano so that, for example, each 'piano note' allows a large number of different instrumental sounds (or different pitches, or octave pitches if for example there is only one, or a limited number, of octaves in the keyboard) to be operated depending on the key or chordal choice in the unit of each note. For example, the top position may give a basic note for all units, the next position may give an octave higher (or a second instrumental sound) the same for all units, and so on.

The invention also extends to a musical instrument comprising a keyboard according to the invention. For example, a guitar may comprise such a keyboard in which the units are spaced along the back of the guitar neck for operation by the thumb of a hand that does the guitar fingering. This can enable the thumb to select base notes (whose pitch depends on the position or chordal arrangement selected in a unit). The units may provide the same selections and simply be repetitions of each other to allow access by the thumb when the hand is in different positions along the neck or again they may be different, e.g. in the pitch (e.g. octave) they produce, to match (approximately) the pitch produced by fingering along a string. Again, the different keys and chordal arrangements in a unit can produce different accompaniments, e.g. in pitch and/or instrumental sound, or again can be used to change the nature of the sound produced by the string being played, or its pitch, by a suitable amplifier/sound processor.

While the main application of the invention is seen to musical instruments, it can also be connected to operate lights selectively, possibly in conjunction with musical sounds so that both are operable from the same keyboard, either selectively or with a particular lighting arrangement operable for every sound arrangement produced.

Again, the invention can be applied in other ways. For example, the unit or keyboard can be connected to operate alpha-numeric characters selectively. If the keyboard comprises a plurality of the aforesaid groups arranged to be operable by respective fingers and each such group can produce a complete range of alphanumeric characters, then operation by the different fingers simultaneously can produce a selected ordered group of alphanumeric characters such as a word on a single operation of a hand. Again, with the large number of easily memorizable selections that the invention may permit, it can be readily used for a language such as Chinese or Japanese having a large number of different characters.

According to another aspect of the invention, there is provided keyboard means comprising a group of keys arranged about a centre in an array extending in two mutually transverse directions and adapted to be operable by a single finger in one or more of the following manners:

(a) so that a single finger with a playing area of maximum diameter 1.5 cm can reach and operate a plurality of at least three of said keys singly or in combinations of two or more thereof without moving the finger more than a maximum distance of 0.5 cm;

(b) so that a single finger with a playing area of maximum diameter 1.5 cm can operate a plurality of at least three of said keys together.

Preferably, each said maximum diameter is 1 cm.

Preferably, said maximum distance is 0.3 cm.

Preferably, each said plurality is at least four.

This does not define the manner of playing; rather, it defines the layout of the keys, i.e. that they are suitably arranged, e.g. by size and geometrical arrangement, for such operation, regardless of whether such operation will actually produce an output. As exemplified herein, such a group constitutes a rosette of reduced size keys (compared with normal keyboard keys each of which has to be large enough (or at least spaced far enough apart) for adjacent fingers to operate adjacent keys together. As exemplified in FIG. 25, a large keyboard may comprise many adjacent such keys, and such a rosette can be notionally discerned substantially all over the keyboard. Again, keyboard means comprising solely the uppermost ring of keys 12 in a simplified form of the FIG. 26 embodiment will comprise a group of keys 12 arranged about a centre (the centre point of the ring) in an array extending in two mutually transverse directions, i.e. circumferentially and diametrically. An important function of such keyboard means is to enable a finger to produce a wide variety or range of outputs, e.g. spanning two octaves or more, with limited movement, e.g. for a person with a disability restricting movement of their fingers, or for a person wanting to span a range not possible on a normal keyboard, or for a person to operate with very limited movement of his thumb-finger on one side of a guitar neck (e.g. see FIG. 12) while his finger-fingers are holding a set of string positions on the opposite side of the guitar neck.

Having said that the keys have the desired layout, in preferred embodiments they are also electrically (or otherwise) connected to provide chordal playing, i.e. pressing a first key produces a first output, e.g. pitch C, pressing a second key produces a second output, e.g. pitch D, while chordally playing both of these first and second keys together produces an output which is not simply the sum of the first and second outputs, in this case pitches C and D, but might for example be pitch E. In fact, a prior keyboard known to the present inventor will produce a C major chord when operating key C, a C minor chord when operating keys C and D together, and a C7 chord when operating the three keys C, C# and D together (and in this case requires simultaneous operation by at least two fingers since the C# key is on a different level from the C and D keys), but cannot when operated together produce a third pitch, e.g. E, different from their respective pitches, e.g. C and D, when operated singly.

DESCRIPTION OF DRAWINGS

Reference will now be made by way of example to the accompanying drawings, in which:—

DETAILED DESCRIPTION

Figure 1:
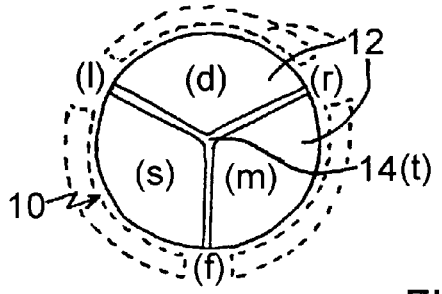
FIGS. 1 to 7 are diagrammatic representations of keyboard units embodying the invention.

Referring to the drawings, a keyboard unit 10 comprises a plurality of keys 12 surrounding a centre 14 and operable singly and chordally by a single finger (which term includes a thumb). The keys 12 of the FIG. 1 embodiment are connected to operate by a single touch selectively the seven major notes of an octave of the musical scale as will be described below. The keys 12 of the FIG. 2 embodiment are connected to operate by a single touch selectively the twelve semitone notes of an octave of the musical scale as will be described below. At least six of the said seven notes of the FIG. 1 embodiment and at least eleven of the said twelve notes of the FIG. 2 embodiment are operable in order going around the centre, as will be described below.

Figure 2:
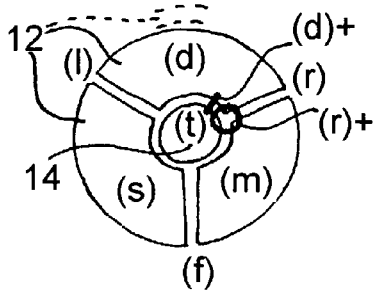

The embodiments of FIGS. 1 and 2 consist of three keys 12 surrounding a centre 14, which in the case of FIG. 1 is a notional point and in the case of FIG. 2 is a key 12. In the drawings, the notes of the tonic sol-fah scale are indicated by their initial letters in brackets, and where appropriate a + or a – sign is used to indicate a semitone up or down respectively. In the FIG. 1 embodiment, in order around the centre 14, the first, second and third keys 12 are connected to operate respectively doh, me, soh, and the first and second keys 12 and the successive other chordal pairs to operate respectively re fah, lah. There is no key 12 at the centre 14 and the three surrounding keys are operable chordally together to operate te. In the FIG. 2 embodiment, there is a centre key operable to operate te. In one form of the FIG. 2 embodiment, only these seven major notes of the octave are operable. In a further form of the FIG. 2 embodiment, the semitone notes are also operable. For example, chordal operation of a surrounding key 12, or an adjacent chordal pair thereof, together with the centre key 12 operates a note a semitone higher than without the centre key. Thus, for example, operation of the doh key and centre key together produces (d)+, while operation of the doh, me and centre keys together produces (r)+. Where there is only a semitone interval between major octave notes, there can be provided a connection for either duplicate response or no response. For example operation of the me and centre keys 12 can produce either nothing or fah. This is the only example that occurs in this embodiment (since doh, te together produces (d)+) but the same principle can be used in variations of the embodiments to be described below. The examples described so far with reference to FIGS. 1 and 2 produce a particularly logical, simple and useful arrangement for a person familiar with music, that he can memorise easily. As a variation, the redundant function (me and te keys together) can be used for some other purpose, e.g. a shift (which term herein is used to include the possibility of shift-lock) function or doh' being an octave higher than doh.

Figure 3:
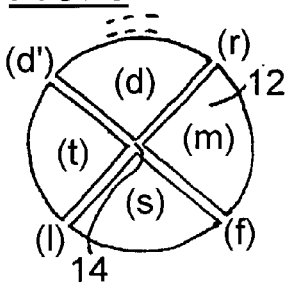
Figure 4:
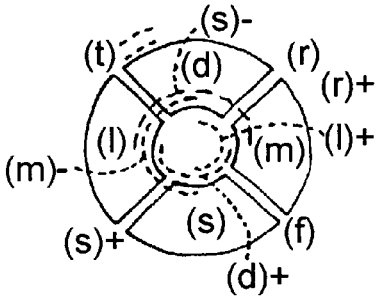
Figure 5:
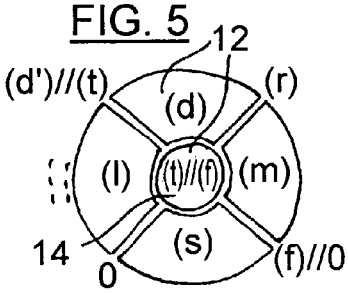

The embodiments of FIGS. 3, 4 and 5 consist of four keys 12 surrounding a centre 14 which, as seen in the respective figures, may be a notional point, a gap or a key 12. As seen in FIG. 3, in order around the centre 14 the first, second, third and fourth keys are connected to operate doh, me, soh, te. The chordal notes are as shown with operation of the te and doh keys together producing doh'. In an alternative form, seen in FIG. 4, in order around the centre, the first, second, third and fourth keys 12 are connected to operate doh, me, soh, lah, with the other major notes operable by chordal operation as shown. Either of these arrangements can be used with either form of FIG. 3 or FIG. 4. However, FIG. 4 by the provision of the gap at the centre 14 enables operation of three keys together without interference with the fourth key. This enables the keys to be connected for chordal operation of the three keys opposite the lah key to operate a note a semitone above lah and similarly with respect to doh, and the three keys opposite the me key (and soh key) to operate a note a semitone below me (and soh respectively), as indicated symbolically by the dashed lines. The keys 12 are then preferably connected for chordal operation of the soh and lah keys together to operate a note a semitone above soh.

FIG. 5 illustrates a said unit in which there is a centre key 12, and this is operable to operate' te. The lah and doh keys can then be operated chordally together to produce doh'. In an alternative form of the FIG. 5 arrangement, the centre key is operable to operate fah. In either case, the chordal' pairs of surrounding keys 12 are operable to operate the other major notes of the octave, as exemplified in FIG. 5. The note arrangements of FIGS. 3 and 4 can be utilised with a centre key 12 (which can be set lower than the surrounding keys in the FIG. 4 case where it is required to operate three surrounding keys 12 together without operating the centre key 12 except by choice). It is then possible for the unit to be arranged for chordal operation of a surrounding key, or an adjacent chordal pair of surrounding keys, 12 together with the centre key 12 to operate a note a semitone higher (or lower) than without the centre key, or both higher and lower e.g. the unit being arranged for chordal operation of a surrounding lah, doh, me or soh key, FIG. 4, together with the centre key to operate respectively the semitones above lah and doh and the semitones below me and soh, chordal operation of soh and lah operating a semitone above soh, thus not requiring triple key operation for any of the 12 notes (one way of providing 12 notes from the 5 single and 8 adjacent pairs of keys used not more than two at a time). As before, the redundant positions may be connected to produce no response, duplicate response, shift of any kind, or any other desired effect e.g. operation of lights or movement, (Thus, for example, operation of the large number of possibilities enabled by embodiments of this invention may allow a performer to play a composition consisting of sequential (as well as possibly simultaneous) operation of notes, lights and/or movements in a mixed. sequence.)

Figure 6:
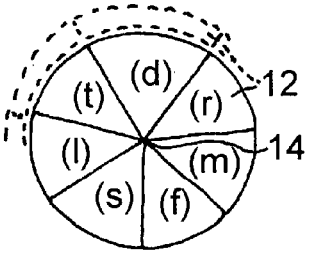
Figure 7:
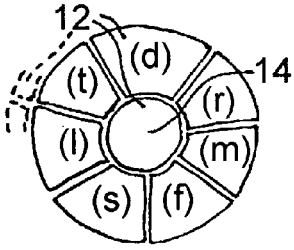

FIGS. 6 and 7 illustrate embodiments consisting of seven keys 12 surrounding a centre 14, which may be a notional point, a gap or a key 12, as shown, just as in FIGS. 3, 4 and 5. The seven keys can be connected to operate the seven major notes of an octave, with adjacent chordal pairs thereof being connected to operate the respective semitones. Operation of the centre key 12 chordally with a surrounding key, or an adjacent chordal pair thereof, 12 can then provide a shift function.

It will be apparent to one skilled in the art that features of the different embodiments can be combined, e.g. by substitution, modification or addition. For example, a said unit can comprise a centre key 12 with the keys being connected for chordal operation of the centre key together with any one or more of the surrounding keys 12 to operate a note a whole number of octaves above (or below) the same without the centre key.

Figure 8:
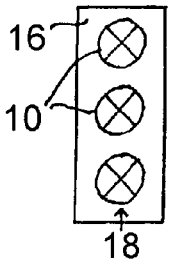
FIGS. 8 to 11 are diagrammatic representations of keyboards embodying the invention and comprising said units.

The embodiments so far described with reference to the drawings can have any of the herein previously mentioned features and advantages. A particularly useful arrangement, for the reasons previously given, is a keyboard comprising a plurality of spaced apart said units 10. As shown in the FIG. 8 arrangement, the keyboard 16 comprises a group 18 of said units 10 arranged to be operable by one and the same finger. In the arrangement shown in FIG. 9, the keyboard 16 comprises a plurality of groups 18 arranged to be operable by respective fingers. For example, the units 10 of group 20 operable by one finger (a thumb) are connected to select one instrumental sound, e.g. drums, those of another group 22 operable by another finger are connected to select a different instrumental sound, e.g. base guitar, those of another group 24 operable by another finger are connected to select a further different instrumental sound, e.g. lead guitar, and so on. The extent and complexity of the arrangement will depend upon the ability of the player and the type of music that he wishes to produce. If required any key or combination of keys can operate with a lock (i.e. toggle) function, electrically or mechanically.

Figure 9:
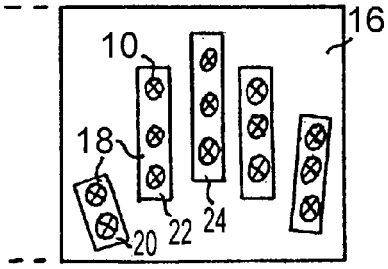
Figure 10:
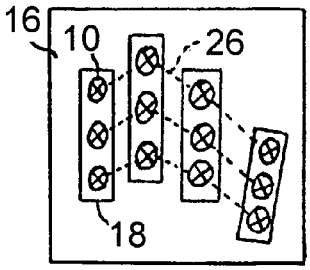

In any of the arrangements described herein, it is possible for the shift operation to be carried out sequentially, i.e. before a playing operation, if so desired. As an alternative to the instrumental sounds being divided "vertically" as seen in FIG. 9, they can be divided "horizontally" as indicated by chain lines 26 in FIG. 10 each of which represents one instrumental sound, so that one said unit 10 in each finger group 18 is connected to be operable to select a first instrumental sound and another said unit 10 in each of the same groups 18 is connected to be operable to select a second instrumental sound and so on. In the arrangements of FIGS. 9 and 10, the said units 10 of each finger group 18 are arranged in a column and the columns are approximately parallel, or slightly out of parallel, to facilitate simultaneous playing of some or all of the groups by a single hand.

Figure 11:
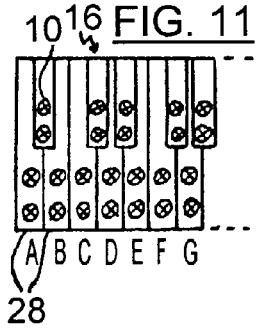

In further arrangements, the units 10 are arranged in positions 28 corresponding to the keys on a piano. There may be one unit 10 in each position 28 or there may be more, e.g. two as shown in FIG. 11. Each key 12 or chordal arrangement of such keys in a unit 10 can be connected to operate, for example, a different instrumental sound (or a different octave, or any other suitable variation) and these can usefully be the same for the corresponding key or arrangement in each of the positions 28. Thus, for example, the top (corresponding to doh) key of the upper unit 10 as seen in FIG. 11 for each position 28 may be the basic note A, B, C etc. in a particular octave, while the same key in the lower unit 10 in each position 28 may be one octave lower. These keys 12 may produce piano sound. If, for example, each unit 10 consists of four keys laid out as in FIG. 3, the left-hand key in each unit 10 may produce the same note but with guitar sound. The right-hand key in each unit 10 may produce the same note with flute sound. The bottom key may produce the same note but three octaves lower with bass sound.

Figure 12:
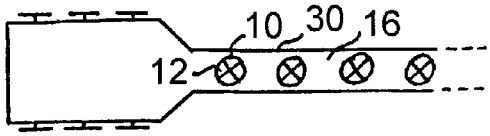
FIG. 12 is a diagrammatic representation of part of the back of a guitar neck comprising a keyboard embodying the invention.

FIG. 12 shows a guitar as described above, comprising a said keyboard 16 in which the units 10 are spaced along the back of the guitar neck 30 for operation by the thumb of a hand that does the guitar fingering.

The unit or keyboard mentioned above connected to operate alphanumeric characters selectively may be laid out as in FIG. 9 or in FIG. 10, whereby simultaneous operation of the different groups 18 can produce simultaneously all the characters of a 4- or 5-character word or grouping or, for example, if keyboard 16 is extended as indicated by dotted lines in FIG. 9 to accommodate the other hand, a 10-character word or grouping can be obtained. One or each thumb may be used only to provide shift functioning.

Figure 13:
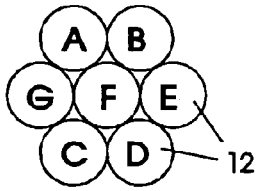
FIGS. 13, 15 and 16 are diagrammatic plan views of sets of keys.
Figure 14:
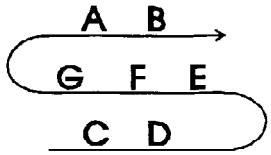
FIG. 14 illustrates the sequence of keys of FIG. 13.
Figure 17:
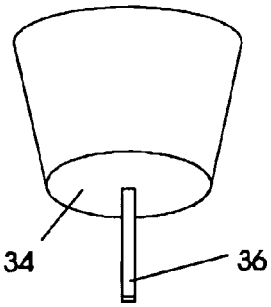
FIG. 17 is an underneath perspective view of a "thimble" which can be placed on the end of a finger to facilitate selection and playing of the keys.

In the FIG. 13 embodiment, the keys C, D, E, F, G, A, B are given their normal sequence in a major scale, as indicated by the sequence shown in order along the arrow in FIG. 14. The whole set of keys shown in FIG. 13 is about 3 cm in diameter, but this could be reduced to about 1 cm in diameter if the end of the finger wears a plastics "thimble" 34 as shown in FIG. 17 which has a plastics extension 36 like a piece of matchstick, about 1 cm long and about 2 mm wide. The tip of this can comfortably operate any one key C to B, or any adjacent pair of such keys, or can if necessary be thicker, or splayed out at its free end, to operate three or more keys simultaneously. The back-up circuitry is so arranged that pressing on the pair of keys C, D produces C' (which is one octave higher than C), and so on, up to a final combination B, E which produces B'.

Figure 15:
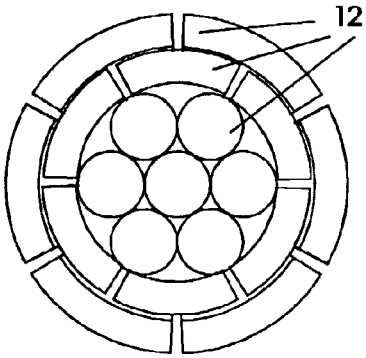
Figure 16:
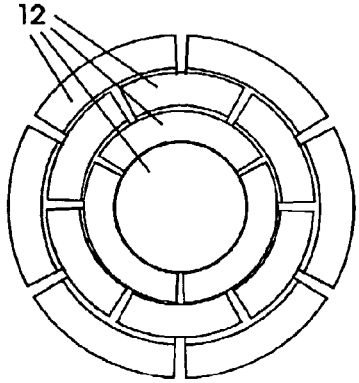

In the embodiment of FIG. 15, a set of keys as in FIG. 13 is surrounded by two circles of substantially long keys. In this complete set, any two or three adjacent keys can be operated together, e.g. by using the "thimble" of FIG. 17. In the embodiment of FIG. 16, there may or may not be one central key, and around the centre there are three concentric circles of "oblong" (substantially rectangular) keys. These can be played in the same manner as those of FIGS. 13 and 15. One or more similar outer circles of long keys 12 may be used in the embodiments of FIGS. 1 to 5, as indicated schematically by the arcuate dashed lines in those Figures.

Figure 18:
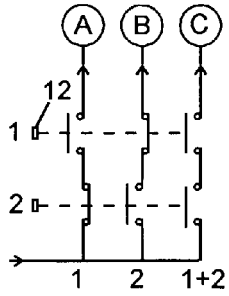
FIGS. 18 to 22 are schematic diagrams of back-up circuitry to produce the different required outputs from the single and chordal operation of the various keys.

In the FIG. 18 arrangement, keys 1 and 2 can be operated singly or together to produce outputs A, B, C respectively, as indicated by the reference at the bottom of each column A, B, C. The supply enters the arrangement, at the bottom left as seen in FIG. 18, and is connected to each of outputs A, B, C by make or break contacts as shown, all of the contacts operable simultaneously by key 1 being shown in the same horizontal row as seen in FIG. 18 connected to key 1 by a dashed line, and similarly for key 2.

Figure 19:
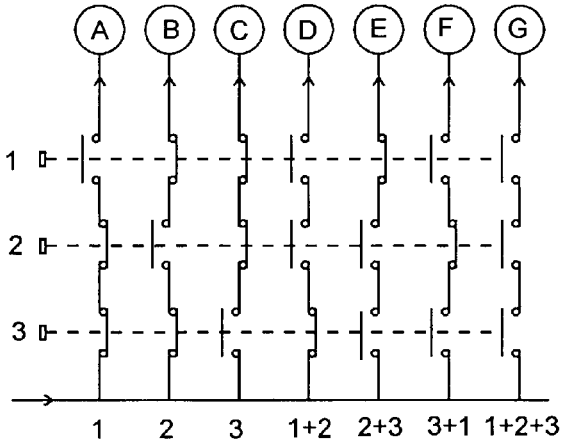

The FIG. 19 arrangement is a development of the FIG. 18 arrangement, using three keys instead of two. If, for example, this arrangement is applied to FIG. 1, so that the first six successive notes of the scale shall be operated in order going round the keys, alternately singly and then that and the next one chordally, i.e. 1, 1+2, 2, 2+3, 3, 3+1, audio generation is arranged so that output A produces doh, output D produces re, output B produces me, output E produces fah, output C produces soh, output F produces la, and output G produces te.

Figure 20:
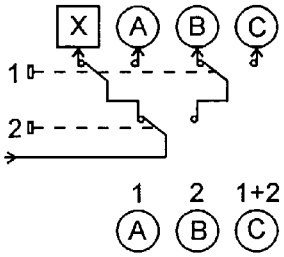

The arrangements of FIGS. 18 and 19 use single-pole contacts, and this needs a parallel supply arrangement. The arrangements of FIGS. 20 and 21 use double-pole contacts, as shown, and can then utilise a branching supply arrangement. Position X is the "off" position, when none of the keys is operated. The arrangements of FIGS. 20 and 21 otherwise operate in the same manner as the arrangements of FIGS. 18 and 19, as indicated by the various columns and rows.

Figure 22:
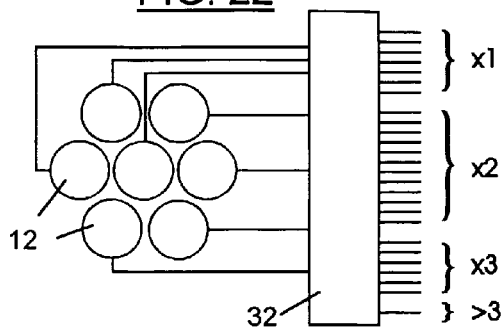
Figure 21:
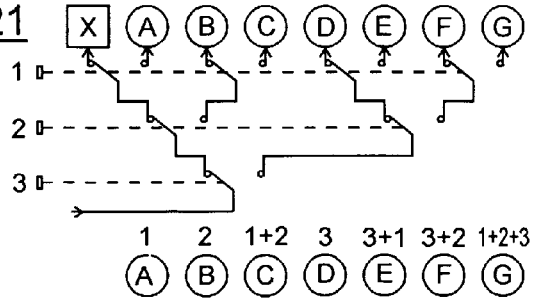

The FIG. 22 arrangement corresponds to the FIG. 13 arrangement, and shows how a single lead from each key can be fed into a logical translator 32 comprising suitable logical circuitry, the equivalent of a developed form of the FIG. 19 arrangement or of a FIG. 21 arrangement, or otherwise, so as to produce a different output ×1 for each single key, ×2 for each pair of adjacent keys that can be operated chordally by a single finger, ×3 for each three adjacent keys that can be operated chordally by a single finger, and ×3 to provide a 26th output to correspond, for example, to the letters of the alphabet if more than three keys are pressed chordally by a single finger.

Figure 23:
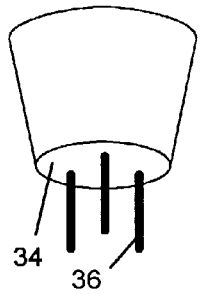
FIG. 23 is a perspective view of another thimble alternative to that shown in FIG. 17.

The thimble 34 shown in FIG. 23 has three extensions 36 which can be used to enable more delicate selection of one, two or three keys 12 chordally, e.g. by positioning and/or tilting the thimble 34 so that one, two or three of extensions 36 engage keys 12. These extensions 36 may be thinner than extensions 36 of thimble 34 of FIG. 17. There may be more than three of them, or only two of them.

Figure 24:
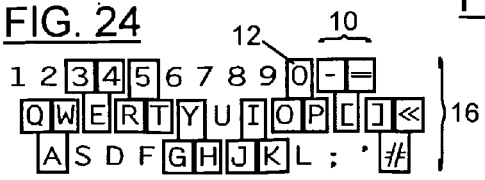
FIG. 24 is a schematic representation of part of a QWERTY keyboard embodying the invention.

The QWERTY keyboard of FIG. 24 has units 10 of three keys 12, each surrounding a common centre, which units 10 are respectively operable by the fingers in turn, going from the little finger of the left hand through all the fingers to the little finger of the right hand (omitting the thumbs), in approximately their normal positions on a QWERTY keyboard and in the following order:

QWA, 34E, 5RT, YGH, IJK, 0OP, –=[,]<<# where << is the Carriage Return key.

These can produce seven different outputs for each finger, using the keys 12 for that finger singly or chordally. The eight fingers can operate substantially simultaneously, or in any desired order. The outputs can be of any of the kinds indicated above, whether music or alphanumeric characters or lighting or otherwise. In another arrangement of the QWERTY keyboard 16, some pairs of two horizontally adjacent keys can be operated chordally to produce accented letters, as in some non-English alphabets, whether or not the arrangement allows three or more keys 12 to be operated chordally.

Figure 25:
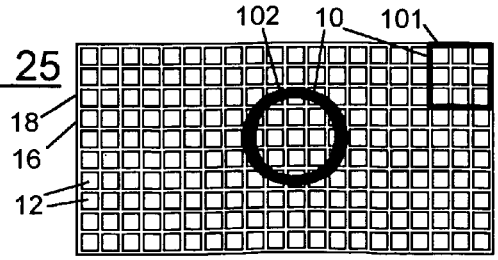
FIG. 25 is a schematic representation of a mosaic keyboard embodying the invention.

The mosaic keyboard arrangement 16 of FIG. 25 allows a finger to be placed anywhere in the mosaic 16 to operate the keys 12 below the finger. A mosaic usually contains more keys than can be operated at once by a single finger; they may be in columns and rows, e.g. as in FIG. 25, or not, e.g. as in FIGS. 15 and 16 (which, as they have relatively few keys, are mosaics if their keys 12 are made large enough, or are spread enough, so that not all can be operated at once by a single finger). It may be the case that none or not all of the keys 12 that are operable chordally are also operable singly (perhaps only those around the edge of the mosaic 16 or at its corners can be operated singly), and vice versa. In an extreme case, while there may be several or many different chordal arrangements of the keys 12 operable, there may be no outputs produced from operation of single keys 12; or again, it may not be geometrically possible for a finger to operate only one key 12.

Also, use of a mosaic 12 having many keys 12 allows a player to use a finger to move over substantially a two-dimensional continuum of the keyboard 16 to produce effectively a two-dimensional continuum of sound (by volume, pitch, timbre or the like or more than one of these) and/or light and/or otherwise. The player may not have to know in detail the effect of each key 12 or chordal arrangement but may simply have to know, or even only sense, the type of variation that will be produced by moving the finger in different directions or to different places on the mosaic 16, or pressing it harder (so that the finger spreads to operate more keys 12 chordally). Thus, the units 10 may be clearly defined and fixed as 101, e.g. the separate units having distinct effects, or may be notional units 10 (floating around keyboard 16), e.g. that merge into neighbouring units 10 as 102 to produce the effect substantially of a continuum.

The mosaic 16 may be a complete keyboard 16, with a logical circuit to enable different parts of it to be operated by different fingers simultaneously. It may again be arranged to operate as a mosaic 18 forming a group 18 of perhaps fewer keys 12 operable by a single finger (e.g. not all at once), with a plurality of such mosaics 18 forming a keyboard 16 in the manner shown in FIGS. 9 and 10.

Again, the keys 12 of the mosaic group 18 or keyboard 16 can be made very small, e.g. of diameter 1 mm, or 1-3 mm, or 1-5 mm, possibly of different diameters in the same mosaic 18, to improve the smoothness of the continuum effect, and units 10 of them, fixed or floating, can be operable by a single finger by, e.g. capacitative, actuation rather than mechanical operation, e.g. with the player being earthed. These features may apply to any of the embodiments described herein.

In any of the embodiments, timing means 33, e.g. software, e.g. in a logical translator 32, may be used with the keys 12 in the manner known with a QWERTY keyboard, to ensure that a player/operator has time to press all the keys 12 of a required combination, so that the output actuated corresponds to the total combination and not to merely a part of it. Indeed, using a QWERTY keyboard 16, FIG. 24, as described above, with its usual backup circuitry, means that its associated computer will not see its keys 12 as pressed simultaneously, but sequentially, and a backup circuit or programme is required to see the operated combination as being all the keys 12 that are pressed within a (short) time interval, e.g. 1/10th second, possibly with "robust choice" (i.e. to determine without ambiguity) redundancy condition/s that they shall only be keys 12 of a predetermined unit 10, and/or shall only be adjacent keys 12. In the case of a QWERTY keyboard 16, the sustain function of an output is produced by continuing to press the combination, which causes the usual QWERTY keyboard 16 to repeat only the last key output of the set of "simultaneously" pressed keys 12, after a presettable interval, which may be e.g. 0.2 sec. For example, pressing QWA substantially together may produce precisely AQW or QAW or any other combination in the initial timed interval, and continued pressure will repeat the last key, e.g. QAW WWWWWW . . . or AWQ QQQQQQ . . . . The key operation, however quick so long as it has been recognised by the circuitry or software, may alternatively cause an output for a predetermined time, e.g. ½ second, with no sustain facility.

The various keys 12 can be used for any combination of controls of sound and/or light and/or other effects, and/or to control of the obtaining of other results, e.g. letters, text and/or pictures on a computer screen. Keyboards 16 comprising (identical or different) sets of keys 12 as illustrated herein can be made very compact and convenient to use.

Figure 26:
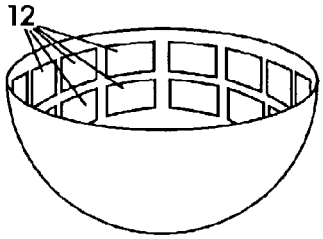
FIG. 26 is a schematic representation of a cup-like keyboard unit embodying the invention.

The keys 12 of a unit 10 may be arranged in a three-dimensional, e.g. hollow, e.g. cup-like, formation 38, FIG. 26, so that a single finger will be able to access more keys 12 in a unit 10 or access them more easily.

Figure 27:
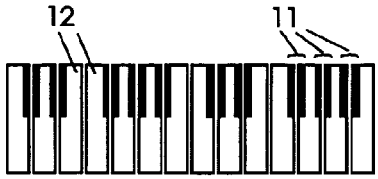
FIG. 27 is a schematic representation of a piano-like keyboard with phantom black notes embodying the invention.

In another arrangement, FIG. 27, a series of keys 12 like the white notes of a piano have painted onto them the usual black notes 11 but these are not present as separate or actual keys, each black note 11 is painted half onto each of two adjacent white keys 12 and, for example, its note in the scale is produced when the two adjacent keys 12 are played together. This can thus produce a piano keyboard 16 with phantom black notes 11. This is thus similar to a linear form of one or a plurality of units 10 of the embodiments of FIGS. 1-7 in arrangements in which not more than two keys are played together, tending also to a linear form of the mosaics 16, 18 described above.

Because the embodiments allow different notes (or rather different selections of keys 12 of a unit 10) to be played with very little movement of a single finger from one to another, keyboards 16 embodying the invention can be very suitable for disabled players, e.g. those with arthritis, who are unable to span a wide range of notes to form a chord (and/or play a sequence of notes in rapid succession) but with a keyboard 16, e.g. as in FIG. 9, 10 or 11, could play simultaneously (or in rapid succession) notes widely separated in pitch with fingers that actually touch the keyboard 16 closely adjacent to one another in respective groups 18, or who are unable to move their hand rapidly from e.g. a playing position to a register-changing position (since the usual electronic keyboard has its register-changing keys in a separate location which may be some distance away from a position in which a hand is playing keys for musical notes) but with a keyboard 16, e.g. again as in FIG. 9, 10 or 11, a unit 10 of selections of keys 12 for one purpose, e.g. register-changing, may be very close to another unit 10 of selections of keys 12 for another purpose, e.g. playing musical notes, e.g. in the same group 18, or there may be both types of selections of keys 12 made available (by suitable circuitry) in a single unit 10.

As mentioned above, any of the illustrated arrangements can be used to operate lights selectively. This can be done with or without instrumental notes.

It will be apparent to one skilled in the art, that features of the different embodiments disclosed herein may be omitted, selected, combined or exchanged and the invention is considered to extend to any new and inventive combination thus formed. Where a preference or particularisation is stated, there is implied the possibility of its negative, i.e. a case in which that preference or particularisation is absent.

For example, listed below are various features within the scope of the invention.

1. Keyboard means comprising a group of keys arranged about a center in an array extending in two mutually transverse directions and adapted to be operable by a single finger in one or more of the following manners:

(a) so that a single finger with a playing area of maximum diameter 1.5 cm can reach and operate a plurality of at least three of said keys singly or in combinations of two or more thereof without moving the finger more than a maximum distance of 0.5 cm;

(b) so that a single finger with a playing area of maximum diameter 1.5 cm can operate a plurality of at least three of said keys together.

2. Means in accordance with feature 1, in which each said maximum diameter is 1 cm.

3. Means in accordance with feature 1 or 2, in which said maximum distance is 0.3 cm.

4. Means in accordance with any one of features 1 to 3, in which each said plurality is at least four.

5. A keyboard unit comprising a plurality of keys surrounding a center and operable singly and chordally by a single finger (which term includes a thumb).

6. A unit in accordance with feature 5, in which the keys are connected to operate by a single touch selectively the seven major notes of an octave of the musical scale.

7. A unit in accordance with feature 5 or 6, in which the keys are connected to operate by a single touch selectively the twelve semitone notes of an octave of the musical scale.

8. A unit in accordance with feature 6 or 7, in which at least six of said seven notes or, as the case may be, at least eleven of said twelve notes are operable in order going around the center.

9. A unit in accordance with any preceding feature, consisting of three keys surrounding a center.

10. A unit in accordance with feature 9, in which in order around the center, the first, second and third keys are connected to operate respectively doh, me, soh of the tonic solfah scale, and the first and second keys and the successive other chordal pairs to operate respectively re, fah, lah.

11. A unit in accordance with feature 9 or 10, in which there is no key at the center and the three surrounding keys are operate chordally together to operate te.

12. A unit in accordance with feature 9 or 10, in which there is a center key operable to operate te.

13. A unit in accordance with feature 12, in which chordal operation of a surrounding key, or an adjacent chordal pair thereof, together with the center key operates a note a semitone higher than without the center key.

14. A unit in accordance with any one of features 5 to 9, consisting of four keys surrounding a center.

15. A unit in accordance with feature 14, in which in order around the center the first, second, third and fourth keys are connected to operate doh, me, soh, te.

16. A unit in accordance with feature 14, in which, in order around the center, the first, second, third and fourth keys are connected to operate doh, me, soh, lah.

17. A unit in accordance with feature 16, in which the keys are connected for chordal operation of the three keys opposite the lah key and the doh key to operate a note a semitone above lah and doh respectively, and the three keys opposite the me key and the soh key to operate a note a semitone below me and soh respectively.

18. A unit in accordance with feature 17, in which the keys are connected for chordal operation of the soh and lah keys together to operate a note a semitone above soh.

19. A unit in accordance with feature 5, in which there is a center key.

20. A unit in accordance with feature 19, when appendant to any one of features 11 to 14, in which the center key is operable to operate te.

21. A unit in accordance with feature 19 when appendant to any one of features 11 to 14, in which the center key is operable to operate fah.

22. A unit in accordance with any one of features 15 or 18 or 20 or 21, arranged for chordal operation of a surrounding key, or an adjacent chordal pair of surrounding keys, together with the center key to operate a note a semitone higher than without the center key.

23. A unit in accordance with feature 15 or 18 or 20 or 21, arranged for chordal operation of a surrounding key, or an adjacent chordal pair of surrounding keys, together with the center key to operate a note a semitone lower than without the center key.

24. A unit in accordance with any one of features 15 or 18 or 20 or 21, arranged for chordal operation of a surrounding lah, doh, me or soh key together with the center key to operate respectively the semitones above lah and doh and the semitones below me and soh.

25. A unit in accordance with any one of features 5 to 8, consisting of seven keys surrounding a center.

26. A unit in accordance with feature 25, in which there is a center chordally operable with a surrounding key, or an adjacent chordal thereof, to provide a shift function.

27. A unit in accordance with feature 5, comprising a center key, the keys being connected for chordal operation of the center key together with any one or more of the surrounding keys to operate a note a whole number of octaves above (or below) the same without the center key.

28. A keyboard unit comprising a plurality of keys adapted for operation by a single finger and substantially according to any embodiment hereinbefore described.

29. A keyboard comprising a plurality of spaced apart said means and/or units, each as claimed in any preceding feature.

30. A keyboard in accordance with feature 29, comprising a group of said means and/or units arranged to be operable by one and the same finger.

31. A keyboard in accordance with feature 30, comprising a plurality of said groups arranged to be operable by respective fingers.

32. A keyboard in accordance with feature 31, in which the means and/or units of a said group operable by one finger are connected to select one instrumental sound and those of another said group operable by another finger are connected to select a different instrumental sound.

33. A keyboard in accordance with feature 31, in which one said means and/or unit in each said finger group is connected to be operable to select a first instrumental sound and another said unit in each of the same groups is connected to be operable to select a second instrumental sound.

34. A keyboard in accordance with any one of features 31 to 33, in which the said means and/or units of each said finger group are arranged in a column and the columns are approximately parallel to facilitate simultaneous playing operation of some or all of the groups by a single hand.

35. A keyboard in accordance with feature 29, in which the said means and/or units are arranged in positions corresponding to the keys on a piano.

36. A keyboard substantially according to any example hereinbefore described.

37. A musical instrument comprising a keyboard according to any one of features 29 to 36.

38. A guitar comprising a keyboard in accordance with feature 29, in which the said means and/or units are spaced along the back of the guitar neck for operation by the thumb of a hand that does the guitar fingering.

39. A means, unit or keyboard in accordance with any one of features 1 to 38, connected to operate alphanumeric characters selectively.

40. A keyboard in accordance with feature 39 when appendant to feature 31, connected for said groups to be operable simultaneously by respective fingers to operate a selected ordered set of alphanumeric characters.

41. A means, unit or keyboard in accordance with any one of features 1 to 40, connected to operate lights selectively.

42. A means, unit or keyboard in accordance with any one of features 1 to 41, comprising a QWERTY keyboard.

43. A means, unit or keyboard in accordance with any one of features 1 to 42, comprising a mosaic keyboard.

44. Keyboard means in accordance with any one of features 1 to 4, comprising a unit, keyboard or musical instrument in accordance with any one of features 5 to 43.

Many variations of the invention and embodiments hereinbefore described will be apparent to people skilled in the art and all such variations are to be considered as falling within the scope of the invention.

The invention claimed is:

1. A keyboard unit comprising: a plurality of keys surrounding a center region and operable singly and chordally by a single finger said keys arranged in an array extending in two mutually transverse directions and adapted to be operable by a single finger with a playing area of maximum diameter 1.5 cm so that the single finger can operate a plurality of at least three of said keys together.

2. A keyboard unit comprising a group of keys arranged about a center in an array extending in two mutually transverse directions and adapted to be operable by a single finger with a playing area of maximum diameter 1.5 cm so that the single finger can reach and operate a plurality of at least three of said keys singly or in combinations of two or more thereof without moving the finger more than a maximum distance of 0.5 cm.

3. The keyboard unit as claimed in claim 1, in which each said maximum diameter is 1 cm.

4. The keyboard unit as claimed in claim 2, in which said maximum distance is 0.3 cm.

5. A unit as claimed in claim 1, in which the keys are connected and configured to selectively operate by a single touch the twelve semitone notes of an octave of a musical scale.

6. A unit as claimed in claim 1, wherein said plurality of keys comprise a center key.

7. A unit as claimed in claim 1, wherein said keys are arranged for chordal operation of a surrounding key, or an adjacent chordal pair of surrounding keys, together with a center key to operate a note a semitone higher than without the center key.

8. A unit as claimed in claim 1, wherein said keys are arranged for chordal operation of a surrounding key, or an adjacent chordal pair of surrounding keys, together with center key to operate a note a semitone lower than without the center key.

9. A keyboard as claimed in claim 1, comprising a plurality of spaced apart key units.

10. A keyboard as claimed in claim 9, comprising a plurality of said key units arranged to be operable by one and the same finger.

11. A keyboard as claimed in claim 10, comprising a plurality of said key units arranged to be operable by respective fingers.

12. A keyboard as claimed in claim 11, wherein said key units of each finger are arranged in a column and wherein said columns are approximately parallel to facilitate simultaneous playing operation of some or all of the groups by a single hand.

13. The keyboard as in claim 9, wherein said keyboard is in the form of a musical instrument.

14. The keyboard as in claim 9, wherein said keys are spaced along a back of the guitar neck for operation by the thumb of a hand that does the guitar fingering.

15. A keyboard comprising keyboard units as claimed in claim 1, wherein said keys are connected and configured to selectively operate alphanumeric characters.

16. A keyboard as claimed in claim 15, wherein said keys are connected and configured to be operable simultaneously by respective fingers to operate a selected ordered set of alphanumeric characters.

17. The keyboard unit as claimed in claim 1, wherein said keys are connected and configured to selectively operate lights.

18. A keyboard comprising keyboard units as in claim 1, wherein said keys are formed as a mosaic keyboard.

19. A keyboard comprising keyboard units as in claim 1, wherein said keys are arranged around a center region so that they are operable by a single finger.

* * * * *